US007962973B2

(12) United States Patent
Sikirov

(10) Patent No.: US 7,962,973 B2
(45) Date of Patent: Jun. 21, 2011

(54) TOILET DEVICE

(75) Inventor: Dov Berko Sikirov, Bnei Brak (IL)

(73) Assignee: Med-Logic Ltd (IL)

( * ) Notice: Subject to any disclaimer, the term of this patent is extended or adjusted under 35 U.S.C. 154(b) by 752 days.

(21) Appl. No.: 11/952,172

(22) Filed: Dec. 7, 2007

(65) Prior Publication Data

US 2008/0109952 A1 May 15, 2008

Related U.S. Application Data

(63) Continuation-in-part of application No. PCT/IL2006/000700, filed on Jun. 18, 2006, and a continuation-in-part of application No. PCT/IL2005/000653, filed on Jun. 19, 2005.

(51) Int. Cl.
*E03D 11/00* (2006.01)
*A47K 13/00* (2006.01)

(52) U.S. Cl. ..... 4/254; 4/239; 4/483; 4/DIG. 5

(58) Field of Classification Search ..... 4/254, 483, 4/239, DIG. 5
See application file for complete search history.

(56) References Cited

U.S. PATENT DOCUMENTS

| | | | | |
|---|---|---|---|---|
| 4,012,797 | A * | 3/1977 | Kristoffersen | 4/300 |
| 4,133,062 | A * | 1/1979 | Fulbright, Jr. | 4/246.1 |
| 4,310,934 | A * | 1/1982 | Hennessy et al. | 4/321 |
| 4,348,776 | A * | 9/1982 | Sarjeant | 4/DIG. 5 |
| 4,716,602 | A * | 1/1988 | Brickhouse | 4/237 |
| 4,819,277 | A | 4/1989 | Sikirov | |
| 5,373,589 | A * | 12/1994 | Rego et al. | 4/300.3 |
| 5,564,135 | A | 10/1996 | Jones et al. | |
| 6,199,228 | B1 * | 3/2001 | Kallweit | 4/667 |
| 6,256,800 | B1 * | 7/2001 | Isbit | 4/254 |
| 6,782,565 | B2 * | 8/2004 | Hinton | 4/484 |
| 2004/0231037 | A1 * | 11/2004 | Erves | 4/300.3 |

FOREIGN PATENT DOCUMENTS

| | | |
|---|---|---|
| RU | 36224 | 10/2004 |
| WO | 2003074799 | 9/2003 |

OTHER PUBLICATIONS

International Search Report from International Application No. PCT/IL2006/000700 mailed Feb. 26, 2007.

* cited by examiner

*Primary Examiner* — Khoa D Huynh
(74) *Attorney, Agent, or Firm* — Lando & Anastasi, LLP

(57) ABSTRACT

A toilet device for facilitating defecation by a user in a natural squatting posture over a conventional toilet having a bowl, the device comprising: a platform adapted to support a user and having areas for a user's feet and an opening therethrough designed to be aligned with the toilet bowl; and a urinal pan to serve a user is in a squatting posture, said urinal pan comprising a front wall and side walls, one edge thereof mounted to said platform and adapted to be pivotably adjustable between an operative position and an inoperative position, characterized in that the urinal pan walls are comprised of flexible material framed with a rinse hose.

11 Claims, 4 Drawing Sheets

TOILET DEVICE

RELATED APPLICATIONS

This application is a continuation in part of International Patent Application Serial No. PCT/IL2006/000700, filed on Jun. 18, 2006, and a continuation in part of PCT application number PCT/IL2005/000653, filed Jun. 19, 2005.

BACKGROUND OF INVENTION

1. Field of Invention

The present invention relates to a toilet device, in particular a toilet device for use in conjunction with a conventional toilet to facilitate use in a natural squatting posture.

2. Discussion of Related Art

The use of the natural (relatively deep) squatting posture during defecation has been proposed as a healthier and more natural method for defecating. U.S. Pat. No. 4,819,277 (Sikirov) discloses a sanitary appliance useful for such squatting, mountable over a conventional ("western") toilet; and provides evidence of the amelioration of hemorrhoid symptoms upon use of a squatting posture during defecation. Such a squatting posture may also be beneficial against constipation and other ailments.

WO 03/074799 (Sikirov) discloses a squatting toilet similar in concept to that of U.S. Pat. No. 4,819,277, however comprising an improved urinal pan.

It is well known that upon defecation, the urinary bladder also empties. For this reason, in U.S. Pat. No. 4,819,277 and WO 03/074799 the sanitary appliance and squatting toilet, respectively, each comprise a urinal pan to minimize splashing of urine. However, further improvements in such pan are warranted.

SUMMARY OF INVENTION

The present invention relates to a toilet device designed for use in combination with a conventional toilet (i.e. so-called "western style" or sit-down toilet) for facilitating defecation in a natural (relatively deep) squatting posture. The device is designed to be positioned over the conventional toilet, although it may be incorporated as part of the toilet, for example, as disclosed in U.S. Pat. No. 4,819,277, which is incorporated by reference; WO 03/074799 is also incorporated by reference.

It is a particular object of the present invention to provide such a toilet device comprising a urinal pan that is relatively easy to manufacture and use.

Accordingly, the toilet device of the present invention comprising: a platform adapted to support a user and having areas for a user's feet and an opening therethrough designed to be aligned with the toilet bowl; and a urinal pan to serve a user is in a squatting posture, said urinal pan comprising a front wall and side walls, one edge thereof mounted to said platform and adapted to be pivotably adjustable between an operative position and an inoperative position, characterized in that the urinal pan walls are comprised of flexible material attached to a rinse hose. The flexible material may be sheet material, such as cloth or plastic. The rinse hose is preferably attached to the outer edges of the front and side walls of the flexible sheet material, thus forming a frame around the urinal. The rinse hose has nozzles through which rinse water is sprayed unto the walls of the urinal and valves to control the flow of water. Preferably the device also has a cover over the folding urinal. The cover preferably has handles to facilitate lifting and lowering the urinal. The platform may have legs that fold when the platform is raised and extend when the platform is lowered to an operative position. The device of this invention can be mounted pivotally on top of a conventional toilet bowl.

BRIEF DESCRIPTION OF DRAWINGS

The accompanying drawings, are not intended to be drawn to scale. In the drawings, each identical or nearly identical component that is illustrated in various figures is represented by a like numeral. For purposes of clarity, not every component may be labeled in every drawing. In the drawings.

The invention may be more clearly understood upon reading of the following detailed description of non-limiting exemplary embodiments thereof, with reference to the following drawings, in which.

DETAILED DESCRIPTION

Figure 1:
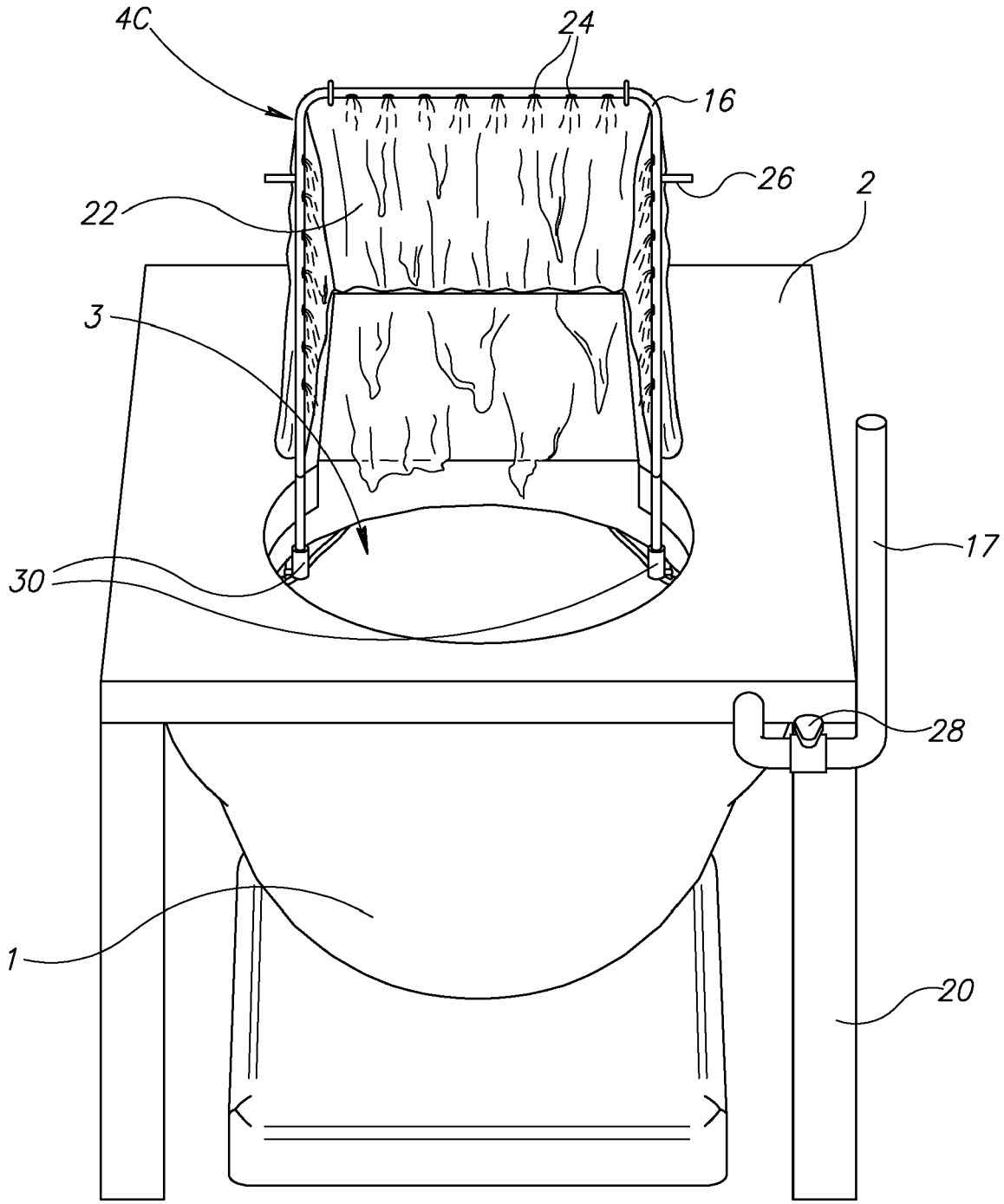
FIG. 1 is a perspective view of a further embodiment of the toilet device of the present invention comprising another modification of the urinal pan.

This invention is not limited in its application to the details of construction and the arrangement of components set forth in the following description or illustrated in the drawings. The invention is capable of other embodiments and of being practiced or of being carried out in various ways. Also, the phraseology and terminology used herein is for the purpose of description and should not be regarded as limiting. The use of "including," "comprising," or "having," "containing", "involving", and variations thereof herein, is meant to encompass the items listed thereafter and equivalents thereof as well as additional items.

Figure 2:
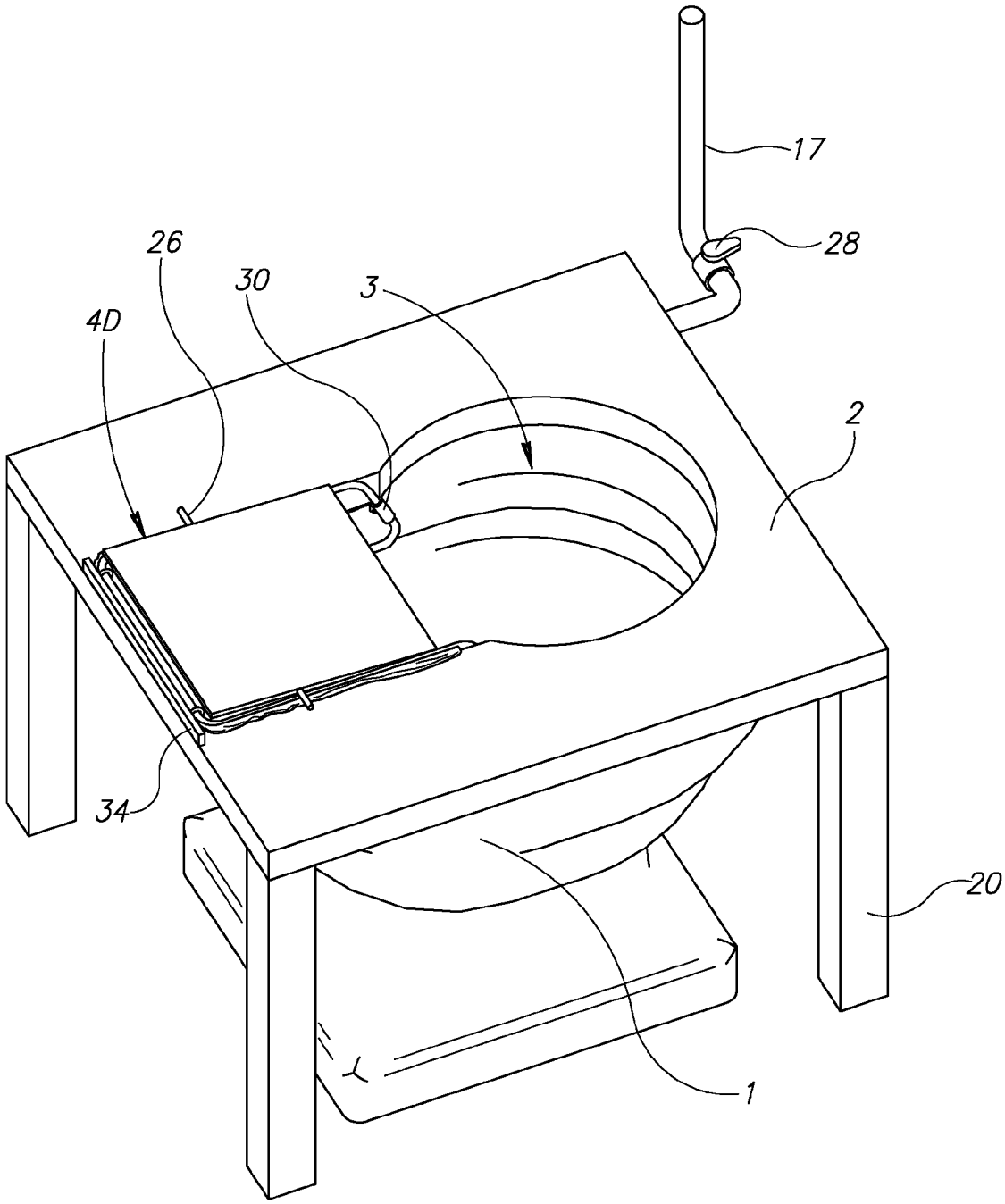
FIGS. 2 and 3 are perspective views of a still further embodiments of the toilet device of the present invention comprising modified urinal pans.
Figure 3:
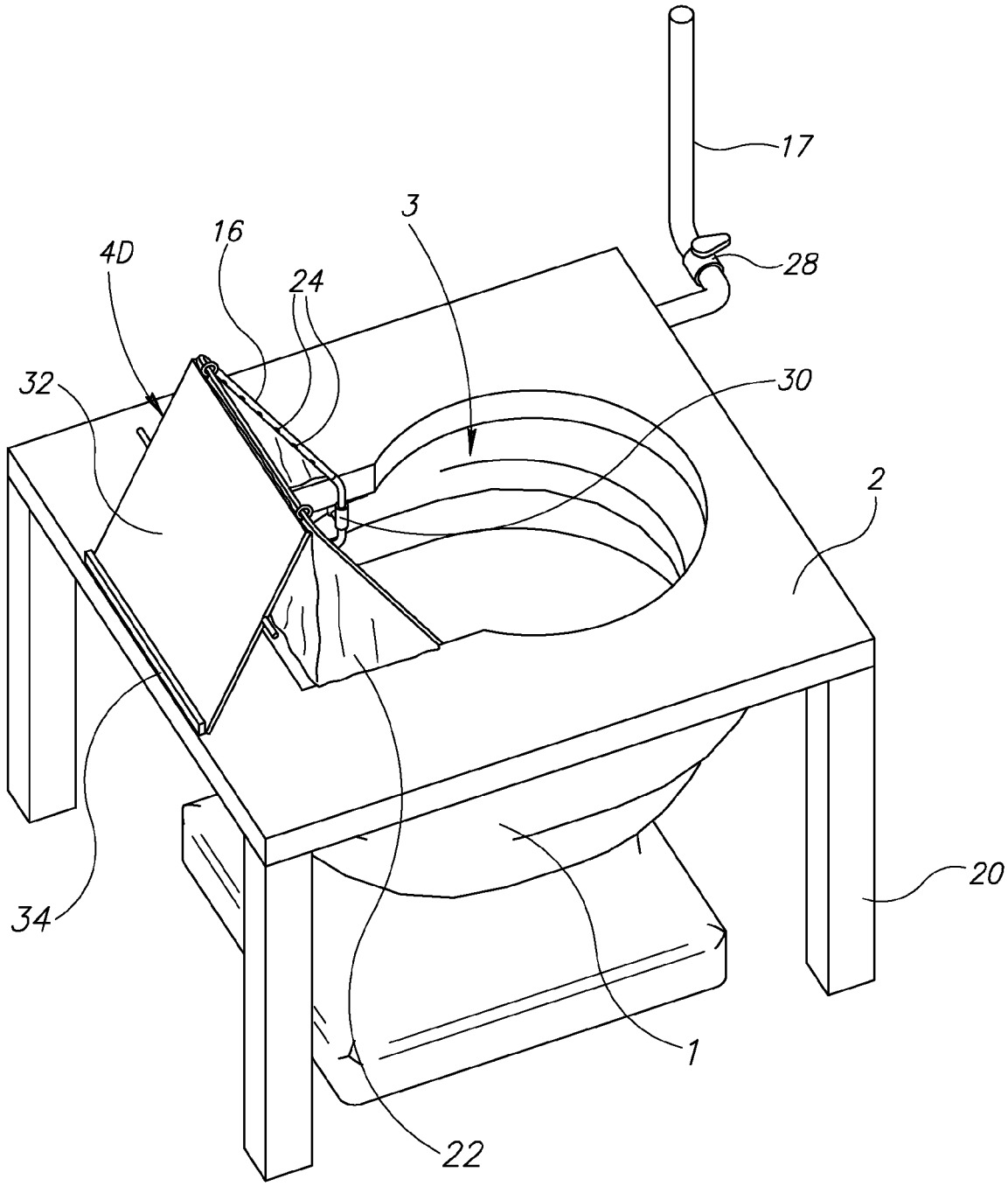

Referring to FIGS. 1-3, these illustrate the toilet device of this invention having a modified urinal pans. In FIG. 1 the toilet device comprises a urinal pan 4*c* comprising sides formed by a sheet 22 (e.g. a urine-resistant cloth or plastic sheet) its bottom edge attached to the platform 2 and its upper edge attached to the rinse hose 16. The platform 2 has an opening 3, and the platform 2 is placed with the opening 3 over the toilet bowl 1. Legs 20 support the platform over the bowl 1. In FIG. 1, it is seen that the hose 16 includes the nozzles 24 to help rinse the urinal pan 4*c*, and one or more handles 26 for raising it so as to form the walls of thereof. In FIGS. 2-3, the rinse hose 16 supports the front and side walls to be pivotably adjustable between an operative position where the front and side walls are raised (FIG. 3) and an inoperative position where the front and side walls are not raised (FIG. 2). The device includes a water inlet pipe 17 and may include a main valve 28 and/or an automatic valve 30, or a pair thereof. Automatic valve 30 is detailed below with reference to FIG. 4.

Such a urinal pan may be held in its operative (upright) position by a variety of mechanisms; one such mechanism illustrated in FIGS. 2 and 3 wherein there is shown a urinal pan 4*d* that is similar to urinal pan 4*c*, however it comprises a cover 32. Not only is such a cover typically more aesthetic, the handles 26 can be attached thereto for raising the urinal pan 4*d* and further be used to fold the cover 32 backward (FIG. 3) whereby the cover's free edge can rest at a support bar 34, thus holding the pan 4*d* in an operative position.

Figure 4:
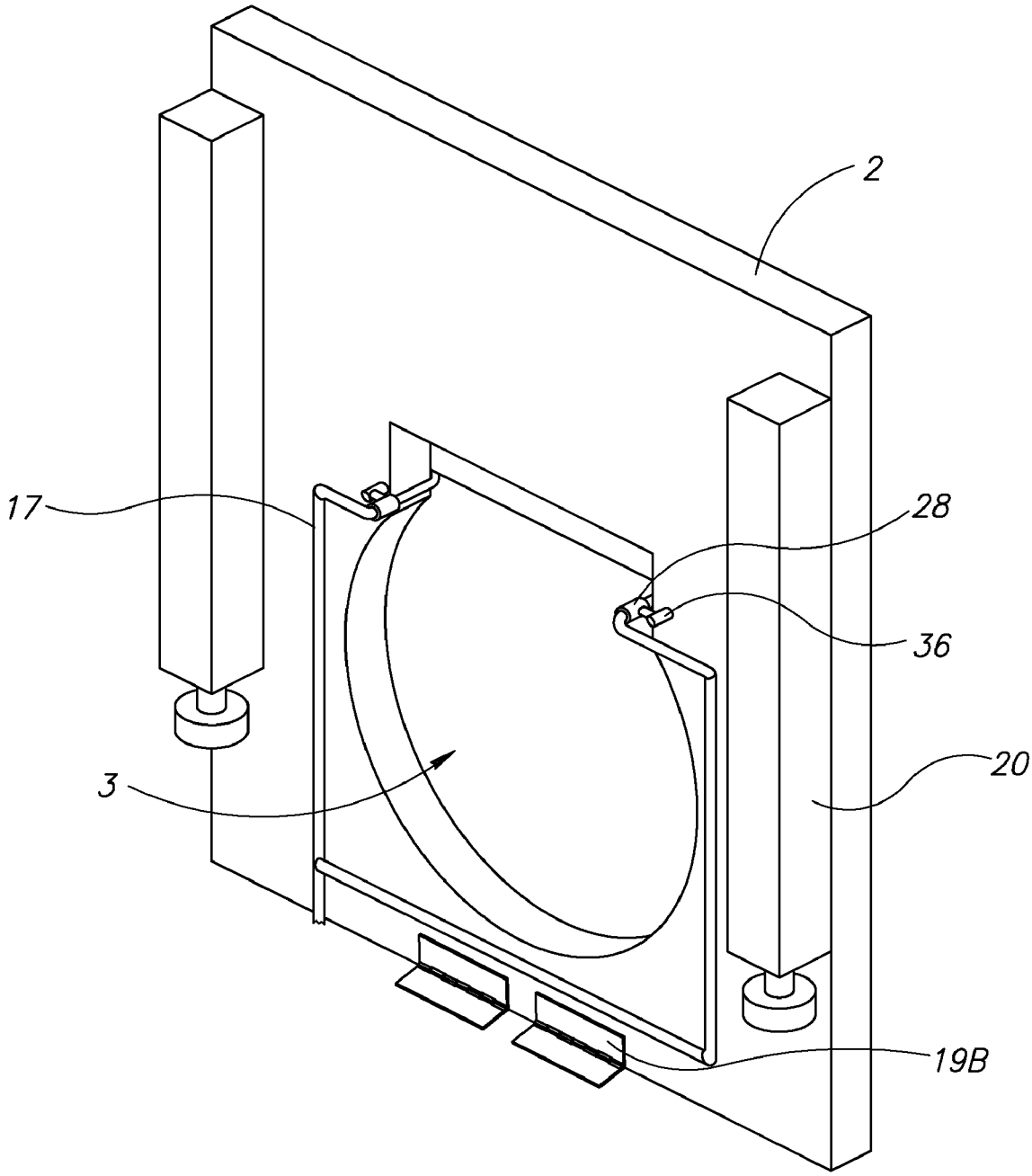
FIG. 4 is a slightly enlarged view of the underside of the toilet device's platform illustrating an exemplary automatic rinsing valve.

FIG. 4 shows the platform mounted pivotally by hinge 19B and a view of the automatic valve 30 wherein it is seen that it comprises a member or valve handle 36 that interfaces with the underside of the platform 2. With such configuration, when the urinal pan 4*c* is lifted and put into its operative position, the valve handle 36 is automatically turned, typically about 30 to 45 degrees, and the automatic valve 30 is opened to supply water for rinsing the pan. Upon returning the pan to its inoperative position, the handle 36 is turned in reverse and the automatic valve 30 is closed.

It should be understood that there are various devices for facilitating defecation in a natural squatting posture that can be devised according to the present invention and that the above description is merely explanatory. Thus, the present toilet device can be embodied in a variety of aspects falling within the scope of the present invention, mutatis mutandis.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A toilet device for facilitating defecation by a user in a natural squatting posture over a conventional toilet having a bowl (1), the device comprising: a platform (2) adapted to support a user and having areas for a user's feet and an opening (3) therethrough designed to be aligned with the toilet bowl (1), and a urinal pan (4*c*) to serve a user in a squatting posture, said urinal pan (4*c*) comprising:

a single sheet of flexible material (22) forming a front wall and side walls, one edge thereof mounted to said platform (2), a rinse hose (16) having one end adapted to attach to a water source to provide water to the toilet device, said rinse hose (16) is attached to and forming a continuous frame around the outer edges of the front and side walls of the flexible sheet material, said rinse hose supports said front and side walls to be pivotably adjustable between an operative position where the front and side walls are raised, and an inoperative position where the front and side walls are not raised.

2. The device according to claim 1, wherein the urinal pan walls are made of flexible plastic sheet material.

3. The device according to claim 1, wherein the urinal pan further comprises a cover covering said pan when in its inoperative position.

4. The device according to claim 1, wherein the rinse hose is attached to a water source and has a valve for controlling the water supply for rinsing the urinal pan.

5. The device according to claim 3, wherein the cover is adapted to support the urinal pan in its operative position.

6. The device according to claim 1, wherein the rinse hose comprises a plurality of nozzles that direct a water spray at the open urinal pan for rinsing.

7. The device according to claim 1, when it is incorporated with a toilet.

8. The device according to claim 1, wherein the platform is supported by legs that may be foldable.

9. The device in accordance with claim 1, wherein the urinal pan has handles for raising and lowering it.

10. The device in accordance with claim 1, comprising valves to control the flow of water through the rinse hose.

11. The device according to claim 1, comprising a cover for the urinal pan, one edge of the cover being free and the other edge being foldably attached to the outer edge of the front wall of the urinal pan.

* * * * *